United States Patent [19]

Lagowski

[11] 4,290,653

[45] Sep. 22, 1981

[54] COAL MINING MACHINE CUTTER WITH NOISE SUPPRESSANT AND FLAME RESISTANT LAYER

[75] Inventor: Joseph V. Lagowski, Mabscott, W. Va.

[73] Assignee: Fairchild Incorporated, Raleigh, W. Va.

[21] Appl. No.: 61,909

[22] Filed: Jul. 30, 1979

[51] Int. Cl.[3] ..... E21C 35/04; E21C 27/24

[52] U.S. Cl. ..... 299/87; 181/208; 299/12; 407/32

[58] Field of Search ..... 299/12, 87, 89, 90, 299/43; 181/207-209, 296; 175/374, 394, 409, 315; 173/DIG. 1; 408/143, 144; 407/32

[56] References Cited

U.S. PATENT DOCUMENTS

| | | | |
|---|---|---|---|
| 2,107,788 | 2/1938 | Hall | 175/374 X |
| 2,755,881 | 7/1956 | Barrett | 181/207 |
| 3,085,795 | 4/1963 | Snipe et al. | 299/87 |
| 3,292,237 | 12/1966 | Fisher | 407/32 |
| 3,342,530 | 9/1967 | Krekeler | 299/89 |
| 3,833,404 | 9/1974 | Sperling et al. | 181/207 X |
| 4,156,470 | 5/1979 | Bodine et al. | 175/315 X |

*Primary Examiner*—Ernest R. Purser

*Attorney, Agent, or Firm*—Cushman, Darby & Cushman

[57] ABSTRACT

In a mining machine having a power driven cutter including metallic helical blade means having cutting bit means spaced along the exterior periphery thereof, the improvement which comprises the helical blade means having fixedly secured in surface-to-surface contact therewith energy absorbing layer means for dampening vibrations set up in the metal of the helical blade means when the cutter is in power operated cutting relation so as to materially reduce the operating noise level of the cutter within the mine.

6 Claims, 1 Drawing Figure

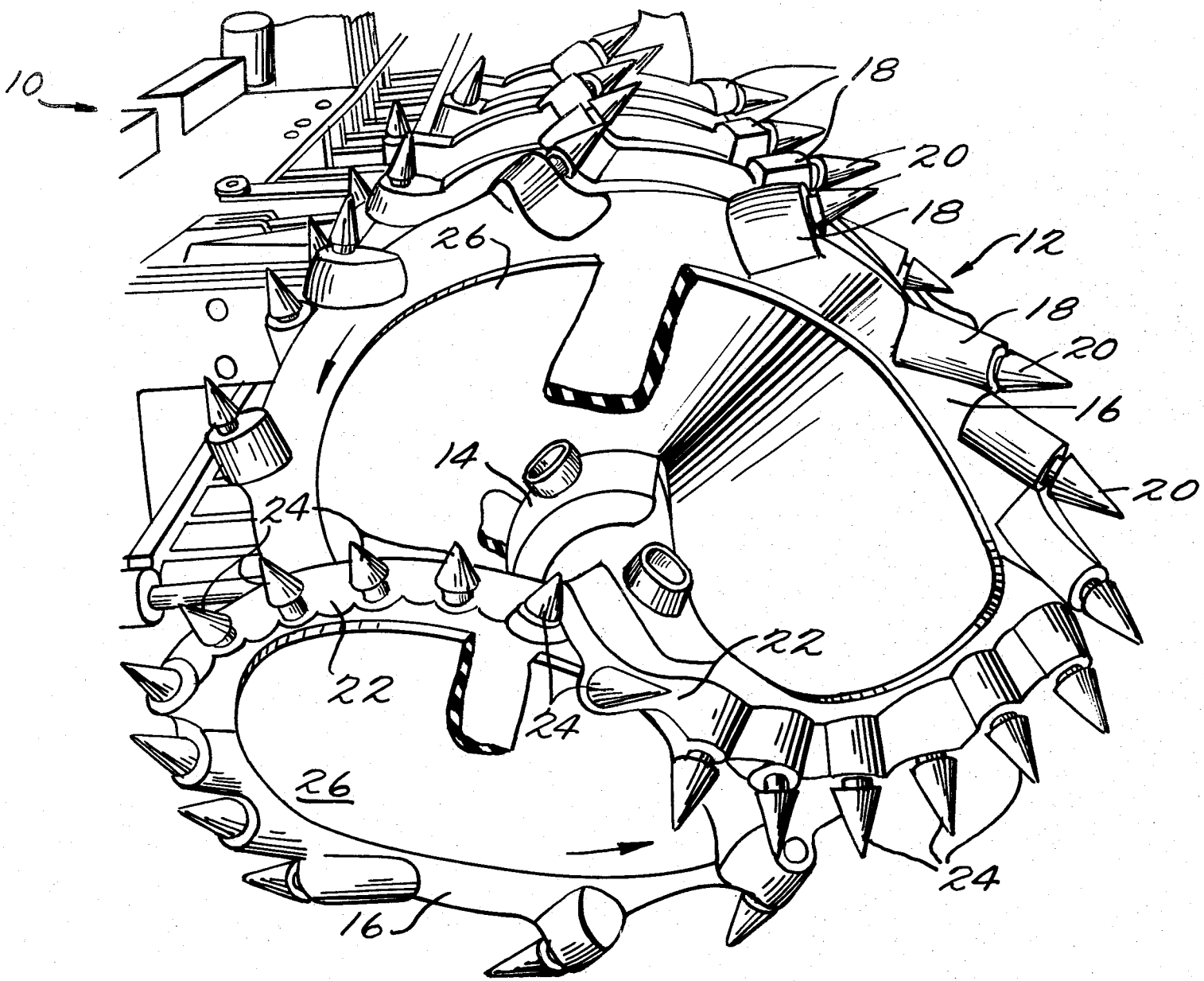
10
12
14
16
18
20
22
24
26

COAL MINING MACHINE CUTTER WITH NOISE SUPPRESSANT AND FLAME RESISTANT LAYER

This invention relates to coal mining and more particularly to improvements in coal mining machines for enhancing the noise suppressant characteristics thereof.

It has long been recognized that underground coal mines present a very hazardous environment to personnel operating therein. The hazards presented are not only with respect to accidental injury but also have to do with the quality of the air available to breathe and the noise level to which the personnel are subjected. The Federal Safety Rules and Regulations administered by the Mining Enforcement and Safety Administration (MESA) of the U.S. Department of Interior recognizes all of these safety hazards. With respect to the noise level hazards, one of the most severe problems in this regard is presented by virtue of the cutting action of a continuous mining machine.

It is an object of the present invention to alleviate this problem and to provide noise suppressant improvements specifically relating to the cutting action of a continuous mining machine.

In accordance with the principles of the present invention, this objective is obtained by providing in a mining machine having a power driven cutter including metallic helical blades having cutting bits spaced along the exterior periphery thereof an energy absorbing layer in fixed surface-to-surface contact with the helical blades. The energy absorbing layer is preferably a layer of styrene butadiene rubber material vulcanized in surface-to-surface contact with the helical blades, the styrene butadiene rubber material having a durometer of the order of 59 and a flame spread index of less than 25, according to ASTM-E162. Preferably, the layer is of generally uniform thickness of between ½" to ¾". Preferably the layer is secured to the inoperative surface of each helical blade so as to extend over at least 60% of such inoperative surface. The energy absorbing material serves to dampen vibrations set up in the metal of the helical blades during the cutting action in the coal seam.

Tests have shown that in dealing with a 26" auger cutter having an energy absorbing layer of the preferred construction vulcanized thereto, results in a reduction in the noise level of as much as 3 dba. The indication is that a greater noise suppressant level could be achieved with respect to cutters of larger diameter.

Another object of the present invention is the provision of an improvement of the type described which is simple in construction, economical to manufacture, and effective in operation.

These and other objects of the present invention will become more apparent during the course of the following detailed description and appended claims.

The invention may best be understood with reference to the accompanying drawings, wherein an illustrative embodiment is shown.

The drawing illustrates a perspective view of an aguer cutter of a continuous mining machine having the improvements of the present invention embodied thereon.

Referring now more particularly to the drawings, there is shown therein a fragmentary perspective view of a continuous mining machine, generally indicated at 10. The perspective view emphasizes the configuration of one auger cutter, generally indicated at 12, of the machine 10. The machine includes two such auger cutters which are oppositely pitched and oppositely power driven and extend forwardly in parallel relation with respect to one another. The mining machine illustrated is available commercially under the trademark WILCOX® MARK 20. The construction is basically disclosed in U.S. Pat. No. 3,026,098, the disclosure of which is hereby incorporated by reference into the present specification. It will be understood that while the improvements of the present invention are illustrated as being applied to an auger cutter 12 of the type embodying in a dual auger continuous mining machine 10, the principles of the present invention are applicable to other cutters as well, as for example, Wilcox U.S. Pat. No. 3,044,753. Continuous mining machines embodying cutters of the type disclosed in the Wilcox U.S. Pat. No. 3,044,753 are available under the trade name Jeffrey 101.

For purposes of illustrating the present improvements, it will be noted that the auger 12 is of the type which is mounted on the frame of the mining machine in forwardly extending cantilevered fashion. The auger cutter includes a central shaft 14 and a pair of helical blades 16 fixed to the periphery of the shaft and extending radially outwardly therefrom in spaced relation with respect to one another. As shown, the spacing is approximately 180° out of phase with respect to one another. Mounted adjacent the exterior periphery of the helical blades 16 is a series of spaced bit holders 18 having cutting bits 20 mounted therein, the bits 20 having their outer cutting portions extending outwardly beyond the periphery of the helical blade. It will be understood that the forward ends of the helical blades are formed so as to have secured thereto a diverging bit holder assembly 22 having a series of generally forwardly and outwardly extending bits 24.

The improvements of the present invention reside in the provision of an energy absorbing layer of material, generally indicated at 26, in fixed relation on the helical blades 16 of each auger cutter 12 of the mining machine. The energy absorbing layer of material 26 serves to dampen vibrations which are set up in the metal of the helical blades during the power driven movement thereof in cutting relation to the coal in the seam of the mine. While it is within the contemplation of the present invention to utilize as the material in the energy absorbing layer 26 any appropriate material which will achieve damping sufficient to substantially reduce the noise level of the cutter in operation, a preferred material is a styrene butadiene rubber material having a durometer of the order of 59 and a flame spread index of less than 25 according to ASTM-E162. The utilization of a material of this type as a layer in a noise suppressant laminate specifically for underground scraper conveyors is disclosed in my commonly-assigned U.S. Pat. No. 4,096,307. For purposes of disclosure as to the styrene butadiene rubber material preferred in the present improvement, the disclosure of my aforesaid patent is hereby incorporated by reference into the present specification. Preferably the layer of styrene butadiene is of generally uniform thickness of from ½" to ¾", a preferred thickness being ½". Preferably, the styrene butadiene rubber material layer is applied to the forward inoperative surface of each of the helical blades so as to extend over an area thereof which is at least 60° to 80° or more. It will be understood that since the cutters are power driven so as to convey the cut or loosened coal in a direction away from the free end of the cutter and toward the frame of the mining machine, the rearwardly facing surfaces of the helical blades constitute the operative conveying surfaces thereof. Conversely, the forward surfaces constitute the inoperative surfaces thereof.

As shown the styrene butadiene rubber material layer 26 extends from the shaft 14 to the marginal periphery of the helical blades within which the holders 18 are secured, the arrangement being such that approximately 60% of the forward inoperative surface of each helical blade is covered. The styrene butadiene rubber material layer 26 is secured in fixed relation to the forward inoperative surface over the area aforesaid by applying the same to the surface in an unvulcanized condition and then vulcanizing the same in situ, the vulcanization procedure effecting the fixed securement in surface-to-surface contact.

A WILCOX® MARK 20 continuous mining machine having a pair of augers 12, each having the improvement of the present invention in the form of preferred styrene butadiene rubber material layer 26 applied to both helical blades in the manner previously described, serves to reduce the noise level during operation approximately 3dba. Accordingly, it will be understood that the present invention contemplates utilization of different materials and the application of materials at different locations on the cutters, so long as noise operational levels of a compatible extent are secured.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a mining machine having a power driven cutter including metallic helical blade means having cutting bit means spaced along the exterior periphery thereof, the improvement which comprises said helical blade means having fixedly secured in surface-to-surface contact therewith energy absorbing layer means for dampening vibrations set up in the metal of said helical blade means when said cutter is in power operated cutting relation so as to materially reduce the operating noise level of said cutter within the mine, said layer means being of flame resistant resilient material having a flame spread index of less than 25 according to ASTM-E162.

2. In a mining machine having a power driven cutter including metallic helical blade means having cutting bit means spaced along the exterior periphery thereof, the improvement which comprises said helical blade means having fixedly secured in surface-to-surface contact therewith energy absorbing layer means for dampening vibrations set up in the metal of said helical blade means when said cutter is in power operated cutting relation so as to materially reduce the operating noise level of said cutter within the mine, said layer means being of flame resistant resilient material comprising a layer of styrene butadiene rubber material vulcanized in surface-to-surface contact with said helical blade means, said styrene butadiene rubber material having a durometer of the order of 59 and a flame spread index of less than 25 according to ASTM-E162.

3. The improvement as defined in claim 1, or 2, wherein said layer is of a generally uniform thickness of between $\frac{1}{2}''$ to $\frac{3}{4}''$.

4. The improvement as defined in claim 1, or 2, wherein said helical blade means includes two helical blades displaced 180° apart each having opposed surfaces one of which constitutes an operative conveying surface and the other of which constitutes an inoperative surface, said layer being secured to the inoperative surface of each helical blade.

5. The improvement as defined in claim 4 wherein said layer extends over at least 60% of the inoperative surfaces of said helical blades.

6. The improvement as defined in claim 4 wherein said layer is of a generally uniform thickness of between $\frac{1}{2}''$ to $\frac{3}{4}''$.

* * * * *